US009855756B2

(12) United States Patent
Ueki

(10) Patent No.: US 9,855,756 B2
(45) Date of Patent: Jan. 2, 2018

(54) METHOD FOR ACQUIRING INFORMATION ABOUT ATTACHMENT OF ARTICLE, AND PRINTING APPARATUS

(71) Applicant: CANON KABUSHIKI KAISHA, Tokyo (JP)

(72) Inventor: Hideyuki Ueki, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/208,031

(22) Filed: Jul. 12, 2016

(65) Prior Publication Data

US 2017/0015103 A1 Jan. 19, 2017

(30) Foreign Application Priority Data

Jul. 15, 2015 (JP) ..... 2015-141408

(51) Int. Cl.
*B41J 2/175* (2006.01)

(52) U.S. Cl.
CPC ..... *B41J 2/17546* (2013.01); *B41J 2/17543* (2013.01)

(58) Field of Classification Search
CPC ..... B41J 2/17543; B41J 2/17546; B41J 2002/17583
See application file for complete search history.

(56) References Cited

U.S. PATENT DOCUMENTS 5,069,438 A * 12/1991 Urban ..... B65H 1/04 271/10.05
5,761,566 A * 6/1998 Suzuki ..... B41J 2/17546 399/12
8,646,884 B2 * 2/2014 Ishibe ..... B41J 2/1752 347/50
2004/0056910 A1 * 3/2004 Usui ..... B41J 2/17503 347/7
2005/0099644 A1 * 5/2005 Nomoto ..... G06F 3/1208 358/1.12
2008/0066554 A1 * 3/2008 Root ..... G01H 17/00 73/649
2009/0219310 A1 * 9/2009 Kondo ..... B41J 2/17566 347/7
2009/0244166 A1 * 10/2009 Sugahara ..... B41J 2/1752 347/19
2013/0002445 A1 * 1/2013 Stibich ..... E05F 15/20 340/686.6
2014/0185069 A1 * 7/2014 Seto ..... G06K 15/4065 358/1.9
2014/0216172 A1 * 8/2014 Katsaros ..... G01L 1/255 73/862.59

FOREIGN PATENT DOCUMENTS

JP 2009-73073 A 4/2009

* cited by examiner

*Primary Examiner* — Stephen Meier
*Assistant Examiner* — John P Zimmermann
(74) *Attorney, Agent, or Firm* — Canon USA, Inc. I.P. Division

(57) ABSTRACT

During attachment or detachment of an article to or from an attaching portion, a coded vibration pattern is generated by contact between the attaching portion and the article. Information about attachment or detachment of an article is acquired by detection of a vibration pattern using a vibration sensor and analysis.

12 Claims, 9 Drawing Sheets

CODE TABLE A

| INSERTION | | | | | | | | |
|---|---|---|---|---|---|---|---|---|
| FRONT END CODE | 1 | 0 | 1 | 0 | 1 | 1 | 0 | 1 |
| MIDDLE CODE | 1 | 0 | 0 | 0 | 0 | 0 | 0 | 1 |
| BACK END CODE | 1 | 0 | 0 | 1 | 0 | 0 | 0 | 1 |
| REMOVAL | | | | | | | | |
| FRONT END CODE | 1 | 0 | 1 | 1 | 0 | 1 | 0 | 1 |
| MIDDLE CODE | 1 | 0 | 0 | 0 | 0 | 0 | 0 | 1 |
| BACK END CODE | 1 | 0 | 0 | 1 | 0 | 0 | 0 | 1 |

CODE TABLE A

| | | | | | | | | |
|---|---|---|---|---|---|---|---|---|
| INSERTION | | | | | | | | |
| FRONT END CODE | 1 | 0 | 1 | 0 | 1 | 1 | 0 | 1 |
| MIDDLE CODE | 1 | 0 | 0 | 0 | 0 | 0 | 0 | 1 |
| BACK END CODE | 1 | 0 | 0 | 1 | 0 | 0 | 0 | 1 |
| REMOVAL | | | | | | | | |
| FRONT END CODE | 1 | 0 | 1 | 1 | 0 | 1 | 0 | 1 |
| MIDDLE CODE | 1 | 0 | 0 | 0 | 0 | 0 | 0 | 1 |
| BACK END CODE | 1 | 0 | 0 | 0 | 1 | 0 | 0 | 1 |

CODE TABLE B

| | | | | | | | | |
|---|---|---|---|---|---|---|---|---|
| INSERTION | | | | | | | | |
| FRONT END CODE | 1 | 0 | 1 | 0 | 1 | 1 | 0 | 1 |
| MIDDLE CODE | 1 | 0 | 1 | 0 | 0 | 1 | 0 | 1 |
| BACK END CODE | 1 | 0 | 0 | 1 | 0 | 0 | 0 | 1 |
| REMOVAL | | | | | | | | |
| FRONT END CODE | 1 | 0 | 1 | 1 | 0 | 1 | 0 | 1 |
| MIDDLE CODE | 1 | 0 | 1 | 0 | 0 | 1 | 0 | 1 |
| BACK END CODE | 1 | 0 | 0 | 0 | 1 | 0 | 0 | 1 |

CODE TABLE C

| | | | | | | | | |
|---|---|---|---|---|---|---|---|---|
| INSERTION | | | | | | | | |
| FRONT END CODE | 1 | 0 | 1 | 0 | 1 | 1 | 0 | 1 |
| MIDDLE CODE | 1 | 0 | 0 | 1 | 1 | 0 | 0 | 1 |
| BACK END CODE | 1 | 0 | 0 | 1 | 0 | 0 | 0 | 1 |
| REMOVAL | | | | | | | | |
| FRONT END CODE | 1 | 0 | 1 | 1 | 0 | 1 | 0 | 1 |
| MIDDLE CODE | 1 | 0 | 0 | 1 | 1 | 0 | 0 | 1 |
| BACK END CODE | 1 | 0 | 0 | 0 | 1 | 0 | 0 | 1 |

METHOD FOR ACQUIRING INFORMATION ABOUT ATTACHMENT OF ARTICLE, AND PRINTING APPARATUS

BACKGROUND OF THE INVENTION

Field of the Invention

The present invention relates to a technique of detecting an attachment state of an article attached to, for example, a printing apparatus.

Description of the Related Art

Japanese Patent Laid-Open No. 2009-73073 discloses a technique of detecting, by a user, that a cable is attached to a USB connector using a vibration sensor.

In the disclosed technique, attachment of the cable is merely detected by capturing vibration at the time of attachment of the cable. If there are a plurality of articles to be attached, the user is not able to know which one has been attached.

In a printing apparatus, for example, a plurality of sheet cassettes are prepared depending on the sheet size, and the printing apparatus may desirably recognize which one has been attached. Alternatively, the printing apparatus may desirably recognize which color ink cartridge has been attached by the user from among a plurality of color ink cartridges. The technique disclosed in Japanese Patent Laid-Open No. 2009-73073 does not satisfy these demands.

SUMMARY OF THE INVENTION

The present invention provides a technique of acquiring information about attachment or detachment of an article to and from an attaching portion in more detail than before in a printing apparatus and other apparatuses.

According to an aspect of the present invention, a method for acquiring information includes: during attachment or detachment of an article to or from an attaching portion, generating a coded vibration pattern by contact between the attaching portion and the article; detecting the vibration pattern by a vibration sensor; and analyzing the detected vibration pattern to acquire information.

Further features of the present invention will become apparent from the following description of exemplary embodiments with reference to the attached drawings.

DESCRIPTION OF THE EMBODIMENTS

An embodiment in which the present invention is applied to an inkjet printing apparatus is described. Besides the printing apparatus, the present invention is broadly applicable to attachment determination in various apparatuses to which articles are attached.

Figure 1:
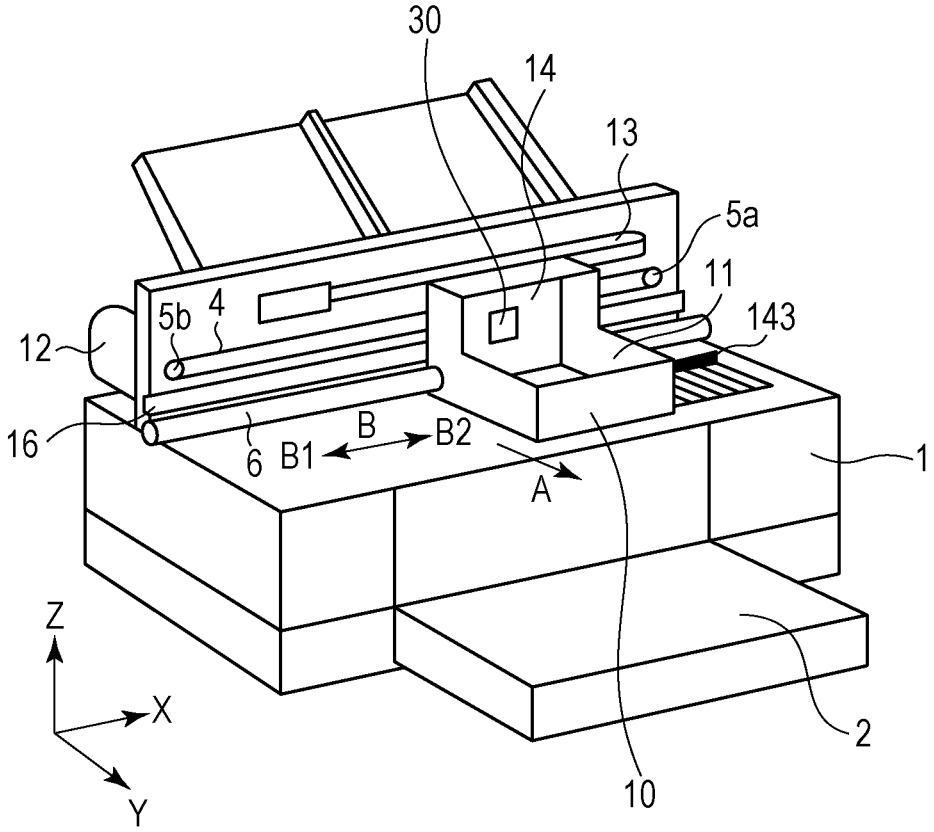
FIG. 1 is a perspective view of an inkjet printing apparatus of an embodiment.
Figure 2:
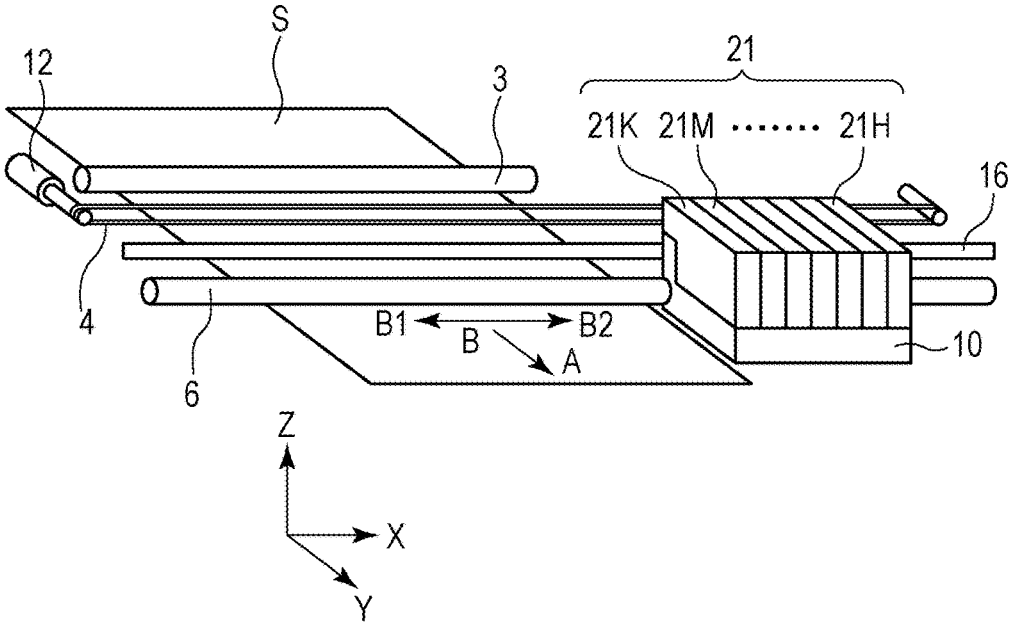
FIG. 2 is a configuration diagram mainly of a printing unit.

FIG. 1 is a perspective view of a configuration of the printing apparatus according to the embodiment, and FIG. 2 is a configuration diagram mainly of a printing unit. These drawings illustrate inside of the apparatus with the outer case removed.

A printing apparatus 1 includes a sheet cassette 2 as a sheet feeding unit in which a plurality of sheets (recording media) are stacked. The sheet cassette 2 is attached and detached to and from a cassette attaching portion of the printing apparatus 1 by a user. A sheet S is fed one at a time from the stacked sheets in the sheet cassette 2 and sent to a printing unit by a conveyance roller 3. The direction A in which the sheet S is conveyed is the Y direction (a sub-scanning direction).

The printing unit includes a carriage 10 which reciprocates in an X direction (a main scanning direction) in the diagram for serial printing. The carriage 10 has an attaching portion 11 to which a plurality of ink cartridges 21 (replaceable cartridges) are detachably attached. Each ink cartridge 21 consists of a print head and an ink cartridge integrated with each other. A carriage motor 12 as a driving source for the reciprocation of the carriage 10 is provided. The driving force of the carriage motor 12 is transmitted to an endless belt 4 which is trained around pulleys 5*a* and 5*b* and connected to the carriage 10. When the endless belt 4 travels in the forward direction (the direction B1) and the opposite direction (the direction B2) as the carriage motor 12 turns forward and backward, the carriage 10 reciprocates along a guide shaft 6 extending in the direction B (the X direction). A cap and a wiper blade 143 used for the maintenance of the print head are provided at one end portion (a home position) in the reciprocation direction of the carriage.

A code strip 16 of an encoder is provided along the X direction. As the carriage 10 is moved, an encoder sensor (an optical sensor) provided in the carriage reads a slit pattern of the code strip 16 and outputs pulse signals. A control unit (described later) detects the position and the moving speed of the carriage 10 counting the pulse signals. The carriage 10 has a sub-electric substrate 14 for local signal processing. The sub-electric substrate 14 and a main electric substrate (the control unit) of the printer main body are electrically connected by a flexible cable 13. A vibration sensor 30 (an acceleration sensor) is mounted in the sub-electric substrate 14. Multipurpose use of the vibration sensor 30 is one of the features of the present embodiment.

FIG. 1 illustrates a state in which no ink cartridge is attached to the attaching portion 11 of the carriage 10, whereas FIG. 2 illustrates a state in which a plurality of ink cartridges 21 are attached to the carriage 10. If the cartridge is attached to the carriage 10 as illustrated in FIG. 2, the sub-electric substrate 14 of the carriage 10 and the vibration sensor 30 thereon are hidden.

Seven ink cartridges 21 are prepared corresponding to color inks of black (21K), cyan (21C), magenta (21M), yellow (21Y), light cyan (21LC) and light magenta (21LM) and a process liquid (21H). Each ink cartridge consists of an inkjet print head and an ink tank integrated with each other.

The print head is an inkjet head provided with a nozzle array consisting of a plurality of nozzles arranged linearly. A heater consisting of an electrothermal transducer is provided in the nozzle. Ink is ejected from the nozzle when the heater is driven. The inkjet head is not limited to the system employing a heater but those employing a piezoelectric element, an electrostatic element, and an MEMS element may also be used. Although the print head and the ink tank are integrated with each other in the ink cartridge in the present embodiment, only the ink tank may be replaced as a cartridge.

As described above, the vibration sensor 30 for detecting acceleration of the carriage is provided in the carriage 10. The vibration sensor 30 is an acceleration sensor for detecting the magnitude of acceleration (vibration) in each of the XYZ three-dimensional axial directions highly sensitively and outputting signals. The acceleration detection signals of the vibration sensor 30 are used for a plurality of purposes.

One of the purposes of the vibration sensor 30 is to detect acceleration for motor control in order to drive the reciprocation of the carriage 10 more accurately. Driving of the carriage is controlled (feedback control, feed-forward control) highly accurately using detection signals of acceleration of the carriage 10 detected by the vibration sensor 30 in addition to the detection signals of position and speed of the carriage detected by an encoder scale 105. In this example, acceleration vibration about the X direction in which the carriage reciprocates among the detecting directions of three axes of the vibration sensor 30 is used.

Another purpose of the vibration sensor 30 is to detect vibration (acceleration) in order to acquire information about attachment or detachment of an attaching object (article), such as the sheet cassette 2 and the ink cartridge 21. The information herein is, for example, information used for determining whether an article is correctly attached to the attaching portion, information representing that an article is detached from the attaching portion when it is detached therefrom, or information representing the type of the article attached to the attaching portion.

The vibration sensor 30 may detect acceleration about three axes of X, Y and Z directions. Therefore, since acceleration is detected in an axial direction in which the amplitude of the acceleration increases when vibration caused by attachment of an article is transmitted to the sensor, even small vibration may be detected sensitively. In attachment state detection of an article, a vibration detection value in the Y direction or the Z direction is desirably used in order to distinguish from large vibration in the X direction caused by the movement of the carriage in the X direction. That is, the vibration sensor 30 detects vibration in a direction different from a main direction of vibration generated by the carriage which is another vibration source. Therefore, an influence of the vibration caused by the movement of the carriage may be reduced and vibration due to attachment may be detected highly accurately.

Figure 3:
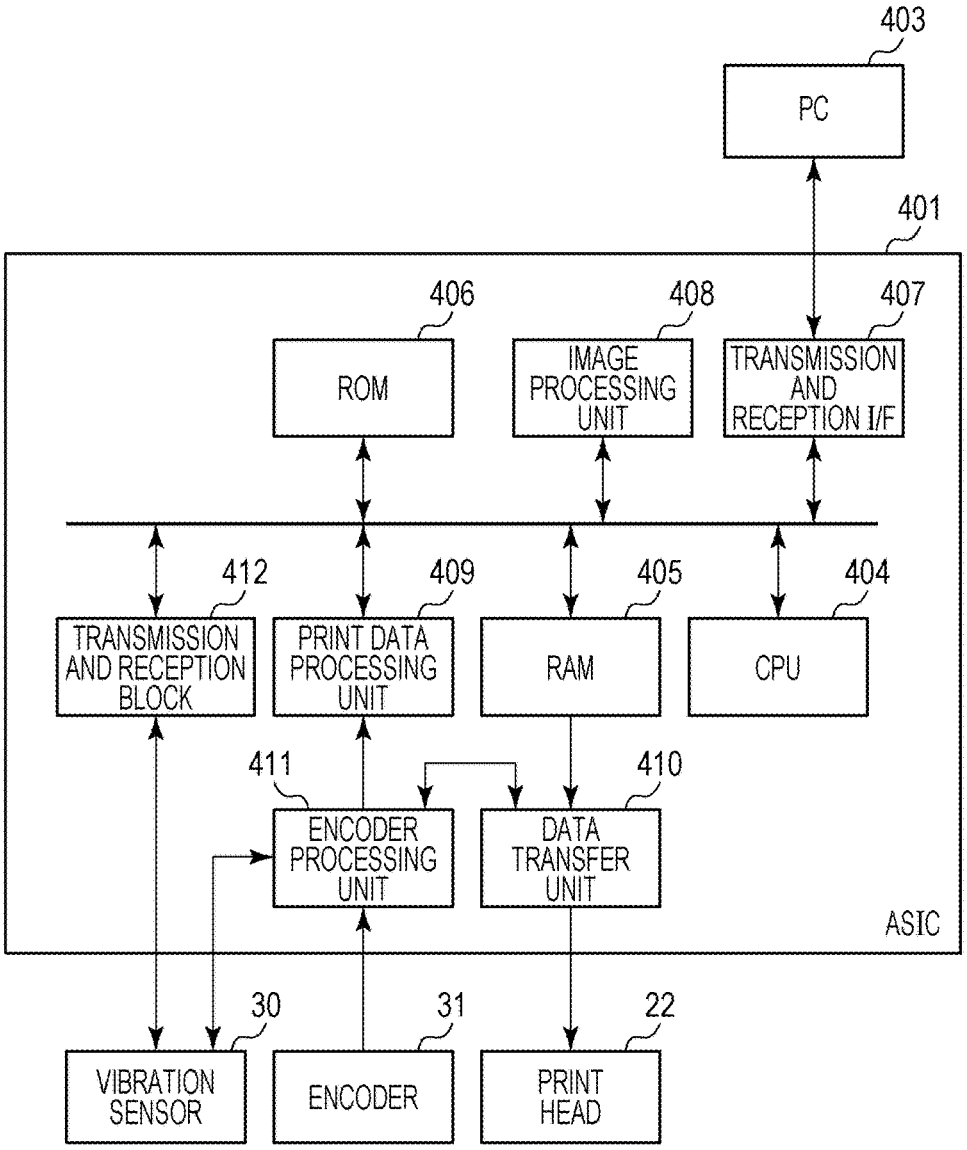
FIG. 3 is a control system block diagram of the printing apparatus.

FIG. 3 is a control system block diagram of the entire printing apparatus 1. An ASIC 401 is the center of the control and a host PC 403 is connected to the ASIC 401. The vibration sensor 30, an encoder 31, and a print head 22 are electrically connected to the ASIC 401. The ASIC 401 includes a CPU 404, RAM 405, and ROM 406. A transmission and reception I/F 407 is an interface with the host PC 403. An image processing unit 408 converts image data into multi-valued data of CMYK color components, and stores the converted multi-valued data in a buffer of the RAM 405. Based on the multi-valued data, dot data which is binary data is generated by a print data processing unit 409. A data transfer unit 410 transfers the generated dot data to the print head 22. Processes in the print data processing unit 409 and the data transfer unit 410 synchronize with heat pulse signals output from an encoder processing unit 411.

In the encoder processing unit 411, signals of the vibration sensor 30 for detecting acceleration of the carriage with signals of the encoder 31 for detecting position and speed of the carriage are input. The encoder processing unit 411 performs acceleration/deceleration control in the reciprocation of the carriage by feed-forward control using these detection signals. A transmission/reception block 412 controls transmission and reception of the sensor of the vibration sensor 30.

Further, the CPU 404, the encoder processing unit 411, and the transmission/reception block 412 cooperatively analyze the detection signals of the vibration sensor 30 and acquire information about attachment or detachment of a printer attachment object, such as the sheet cassette 2 and the ink cartridge 21. Details thereof are described below.

Determination of Attachment of Sheet Cassette

Figure 4:
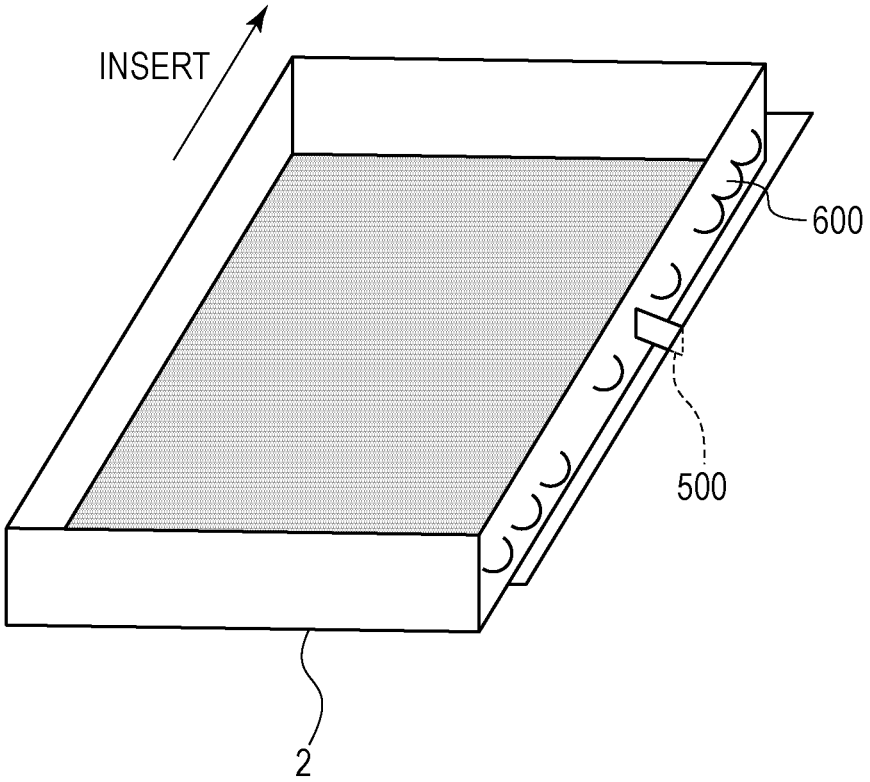
FIG. 4 is an outline diagram of a sheet cassette to which code patterns are applied by projections.

Hereafter, exemplary determination of attachment and detachment or the type of the sheet cassette 2 is described. FIG. 4 is an outline diagram of the sheet cassette 2 in which a plurality of sheets are contained. The sheet cassette 2 is detachably inserted in the cassette attaching portion of a main body of the printing apparatus 1 by a user. A plurality of linearly arranged projections 600 are formed on a side surface of the sheet cassette 2 along an attaching direction of the sheet cassette 2. The arrangement pattern of the projections is a source of information representing a code pattern inherent in that sheet cassette 2. Each of a plurality of sheet cassettes 2 has an inherent different code pattern.

An elastic contact 500 is fixedly provided in the cassette attaching portion of the printing apparatus 1 which faces the sheet cassette 2. The projections 600 are formed integrally with the sheet cassette 2 when resin molding the sheet cassette 2 using a mold with a recessed patterned portion. Alternatively, projecting portions may be attached to the side surface of the sheet cassette 2. The surface on which the projections 600 are formed is not limited to the side surface of the sheet cassette 2. The projections 600 may be formed on a bottom surface or an upper surface of the sheet cassette 2 if vibration may be serially generated when the sheet cassette 2 is inserted or drawn.

When the user pushes the sheet cassette 2 into the cassette attaching portion, an edge of the contact 500 sequentially abuts each of the linearly arranged projections 600 as the sheet cassette 2 is inserted. At this time, the contact 500 vibrates in a unique order and a coded vibration pattern is generated. That is, the contact 500 and the projections 600 may be considered as a vibration generating portion which generates a coded vibration pattern as the article is attached. The vibration pattern has a coded sense depending on the arrangement pattern of the projections 600. A vibration pattern of a reverse code is generated as the user draws the sheet cassette 2.

The vibration generated due to the impact caused when the contact 500 abuts the projections 600 is physically transmitted from the contact 500 to the components of the printer main body, the guide 6, and the carriage 10. The vibration then propagates to the vibration sensor 30 mounted in the sub-electric substrate 14 of the carriage 10. The vibration sensor 30 may detect the vibration of the contact 500 at a distant location inside the printing apparatus 1.

Figure 5:
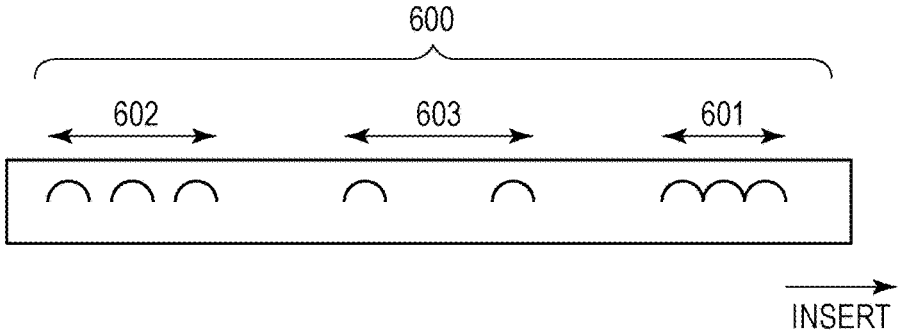
FIG. 5 is a diagram illustrating three types of code patterns.

FIG. 5 illustrates code patterns formed along the direction in which the sheet cassette 2 is inserted (the attaching direction). In FIG. 5, the physically upheaved projections are illustrated schematically and the number of the projections is reduced. A single projection is equivalent to a digit "1" and a flat surface with no projection is equivalent to a digit "0." These digits form a code pattern shape of a bit code string in the direction in which the sheet cassette 2 is inserted. The projections 600 consist of codes of three groups: a front end code 601 representing the front end (the far side) of the sheet cassette 2, a back end code 602 representing the back end (the near side), and a middle code 603 between the front end and the back end.

Figure 6:
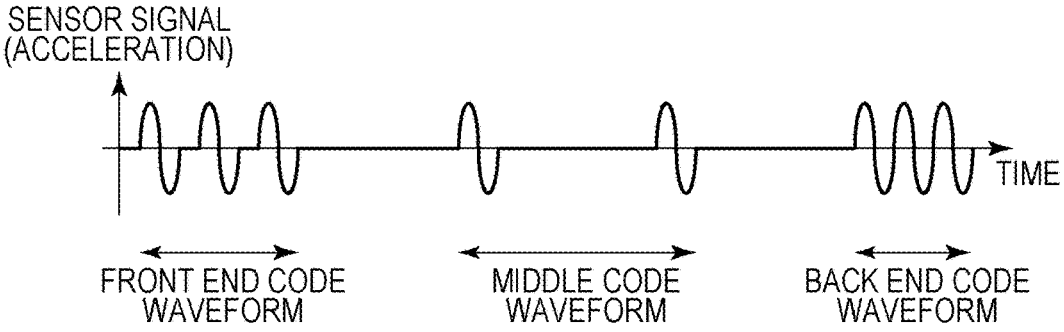
FIG. 6 is a diagram illustrating waveforms output from a vibration sensor.

A coded inherent vibration pattern is generated as the sheet cassette 2 is inserted and the vibration sensor 30 detects the vibration pattern. FIG. 6 illustrates signal waveforms detected and output by the vibration sensor 30. Signals corresponding to the front end code 601, signals corresponding to the middle code 603, and signals corresponding to the back end code 602 are output as waveforms in time series. The waveforms of the output signals are analyzed by the ASIC 401 of the control unit (the signal analysis unit), to determine whether the sheet cassette 2 is inserted completely and determine the type of the sheet cassette 2 (the sheet size and paper type contained therein). If the sheet cassette 2 is inserted incompletely, the waveform of the back end code 602 is not output.

Figures 7A, 7B:
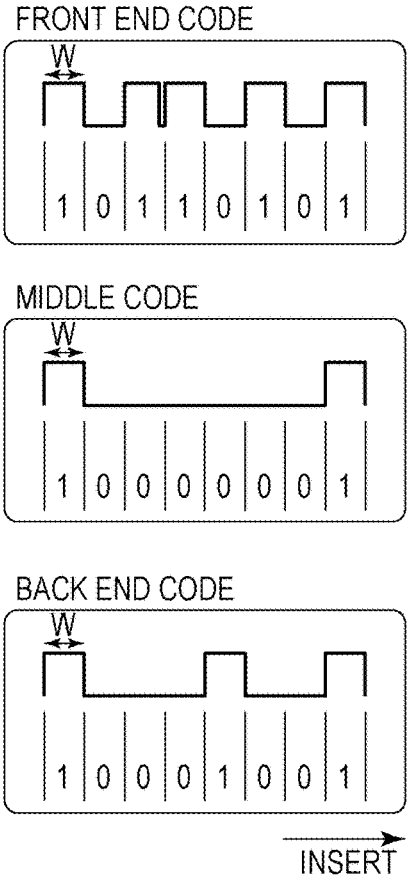
FIG. 7A is a diagram illustrating digitized signal waveforms and FIG. 7B is a code table.

Exemplary codes are described with reference to FIGS. 7A and 7B. Each of the front end code, the middle code, and the back end code consists of a predetermined number of bits. In this example, each code consists of 8 bits. The width W in the diagram corresponds to the width of 1 bit. A code table (see FIG. 7B) including the code information is stored in advance as a data table in ROM 406 of the control unit.

The control unit (the signal analysis unit) analyzes in an analog or a digital way the signal waveform (pulses) of vibration generated by the projection first in order to set the optimal sampling time first. Specifically, the control unit detects a HI level by comparing the sensor output signal of the vibration sensor 30 with a threshold, and measures time until it returns to a LOW level from that time. This time corresponds to the width W, and the measured width W is defined as sampling time t. In an analog process, a comparator compares the sensor signal before AD conversion with a threshold. In a digital process, the digitized value of the sensor signal after AD conversion is compared with a threshold. Then, the control unit performs binary determination whether the sensor signal is in the HI level (1) or a LOW level (0) at every predetermined sampling time t.

In this manner, by setting appropriate sampling time t and reading the value of the vibration sensor, the vibration pattern may be analyzed precisely and code information may be read regardless of the insertion speed (the cassette moving speed in the insertion operation).

The insertion speed can be considered substantially constant without changing greatly in each insertion operation, through it depends on individual users. Therefore, though the time scale extends depends on individual users, the code information may be read uniquely by setting the sampling time t suitable for the extension. Oversampling may be performed by setting sampling time t shorter than the time t. Further, the sampling time t may be reset for each of the front end, the back end, and the middle.

The control unit (the CPU 404) analyzes the detection signal of the vibration sensor 30 and refers to a code table 604 stored in the ROM 406. The control unit retrieves a matching code in the code table about each of the front end, the back end, and the middle.

When all of the front end code, the middle code, and the back end code are output, it turns out that the sheet cassette 2 is attached to the prescribed position. If the back end code is not output while the front end code is output, it turns out that the sheet cassette 2 is not completely attached. That the sheet cassette 2 is detached (not attached) is also determined by the code first output. That is, whether the sheet cassette 2 is being attached or detached is turned out by comparing the 8 bits of the first group output first with the code table. In this case, when the last 8-bit code of the third group is output, it turns out that the sheet cassette 2 is detached reliably.

Information about the sheet size or the paper type of the sheet contained in the sheet cassette 2 is coded in the middle code. By referring to the code table (FIG. 7B) with the read middle code, the sheet size or the sheet type of the sheets in the attached or detached sheet cassette 2 is known. In the middle code, the first and the last bits of the 8 bits are "1" and 6 bits therebetween are in accordance with the type of the sheet cassette 2 and the paper type. With the 6 bits, it is possible to distinguish 64 types. To increase reliability, a part (for example, 1 bit) of the 6 bits may be a parity bit for error detection.

Figures 8A, 8B:
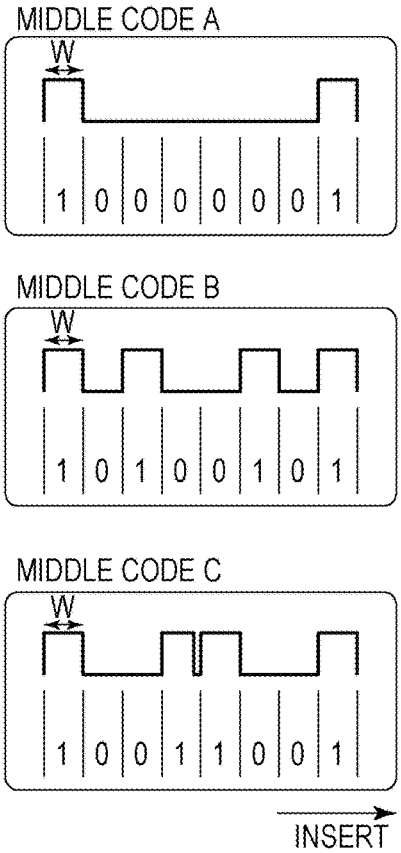
FIG. 8A is a diagram illustrating signal waveforms of a plurality of intermediate codes and FIG. 8B are code tables.

The sheet cassette 2 may be discriminated by the different inherent identification code applied depending on the type of the sheet cassette 2. The middle code as illustrated in FIG. 8A is applied depending on the type of the sheet cassette 2. FIG. 8B illustrates code tables A to C. For example, a middle code A is applied to the sheet cassette 2 for A4 size sheets, a middle code B is applied to the sheet cassette 2 for A3 size sheets, and a middle code C is applied to the sheet cassette 2 for a special medium. As the sheet cassette 2 is inserted, signals of different code pattern in accordance with each of the middle codes A to C as illustrated in FIG. 8A are detected by the vibration sensor. In the middle codes A to C, the bit string is arranged front/rear symmetrically so that the same code is output when the sheet cassette 2 is inserted and removed. In the front end code and the back end code, on the contrary, the bit string is arranged front/rear asymmetrically so that different codes are output when the sheet cassette 2 is both inserted and removed. Therefore, it turns out which article is detached upon detachment in addition to attachment.

Figure 9A:
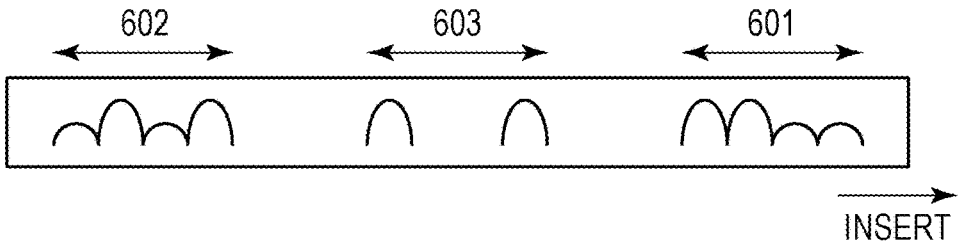
FIGS. 9A to 9C are diagrams illustrating variations of code patterns.
Figure 9B:
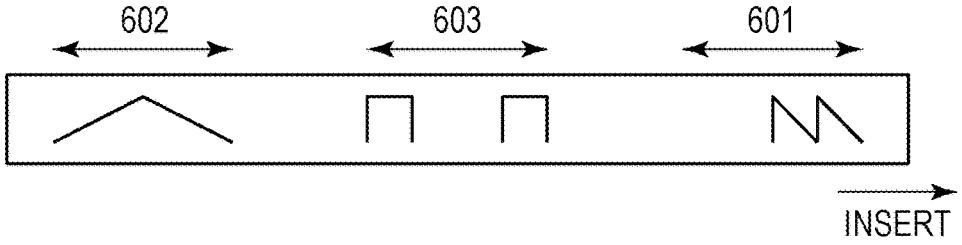
Figure 9C:
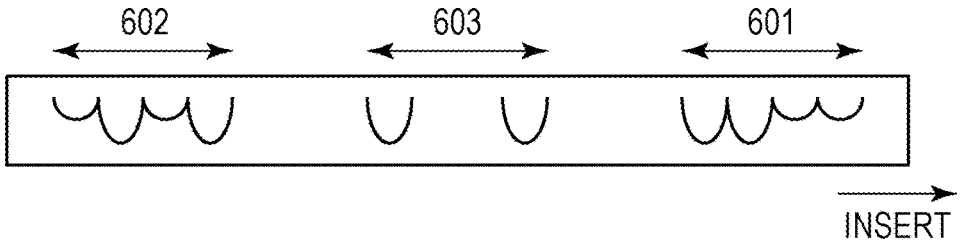

FIGS. 9A to 9C illustrate some variations of the code patterns (vibration sources). FIG. 9A illustrates an example in which two types of projections with different heights are arranged. Magnitude of vibration to be generated varies depending on the height of the projection. A large projection causes a large impact and a small projection causes a smaller impact than the large one. Ternary information of the large projection, the small projection, and a portion with no projection is acquired from the detected values of the vibration sensor. In this manner, a single projection may have multi-value information depending on the height of the projection. Although ternary information is employed in the present embodiment, quaternary or greater information may be employed. However, since priority should be given to the reliability of detection, excessively greater value is undesirable.

FIG. 9B illustrates an example in which the shape of upheaved projections is coded while complicated in an analog way. In FIG. 9B, the physically upheaved shape is illustrated schematically. In the front end code 601 and the back end code 602, the projections are slopes of obtuse angles along the direction in which the sheet cassette 2 is inserted, whereby quiet impact is produced. In the middle code 603, the projections are short rectangular shaped upheavals, which produce sharp impact. These impacts are distinguishable through detailed analysis of the signals of the vibration sensor.

FIG. 9C illustrates an example in which the code pattern is formed by recesses (through holes or non-penetrating hollows) on the side surface of the sheet cassette 2 instead of projections. In FIG. 9C, the recesses are illustrated schematically. When the edge of the contact 500 abuts the recesses, the same impacts as those in the case of the projections are produced. The code pattern may be formed by the combination of projections and recesses.

Figure 10:
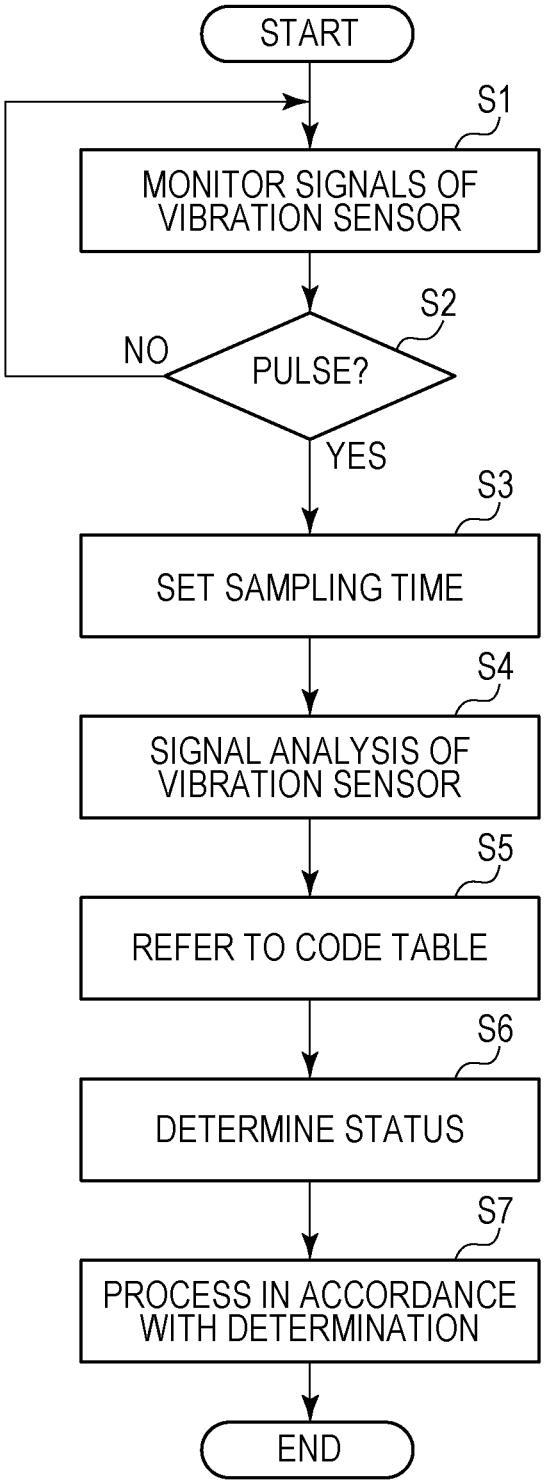
FIG. 10 is a flowchart illustrating a procedure for determining an attachment state.

FIG. 10 is a flowchart of a procedure in the control unit for analyzing the vibration pattern to determine the attachment state.

In step S1, signals of the vibration sensor 30 are monitored to detect attachment or detachment of an attachment object. In step S2, generation of the first pulse in the monitored signals of the vibration sensor 30 is detected. If the signal level is LOW (pulse is not generated), the process returns to step S1 and the loop is repeated, and if the signal level is HI (pulse is generated), the process proceeds to step S3. In step S3, the optimal sampling time t is set depending on the time width of the first signal pulse as described above. In step S4, signals of the vibration sensor 30 are analyzed. Specifically, the vibration sensor 30 compares the detected value with a threshold for every set sampling time t to discriminate HI (1) between LOW (0). In this manner, the codes of three groups of the vibration pattern of the front end code, the middle code, and the back end code are acquired as digital values.

In step S5, the code table is referred to based on the code obtained by the analysis. The CPU 404 retrieves a code in the data table stored in the ROM 406 that matches the code obtained by the analysis. In step S6, if there is a code in the data table referred to that matches all of the three groups, the corresponding attachment state and the type of the sheet cassette 2 are discriminated. If there is no matching code, detection is ignored as no article has been attached.

When the front end code, the middle code, and then the back end code are output, it turns out that the sheet cassette 2 is completely attached to a prescribed position or completely detached. If the back end code is not output after the middle code, it turns out that the attachment/detachment is not performed completely and therefore the attachment/detachment is defective. Information about the sheet size or the paper type of the sheet contained in the sheet cassette 2 is coded in the middle code. Therefore, the sheet size or the sheet type of the sheets in the sheet cassette 2 that is attached or detached is determined from the middle code. It is not necessary that all of the states of the attachment/detachment and types are discriminated, but at least one of them may be discriminated.

In step S7, a predetermined process in accordance with the determined result is performed. The determined type of the sheet cassette 2 (the sheet size and the type) is notified to the host PC and the paper sheet setting of a printer driver is performed automatically. If it is determined that the attachment is defective while the sheet cassette 2 is inserted, the user is notified of the defective attachment and is encouraged to solve the problem. If it is determined that the sheet cassette 2 is not completely detached, the user is notified that the detachment is defective and is encouraged to solve the problem. It is controlled that printing is not performed until the problem is solved. Notification is displayed on a display unit of an operation panel of the main body of the printing apparatus, or displayed on a display unit of the host PC.

Then the processing sequence is completed.

Discrimination of Attachment of Ink Cartridge

The technique of discriminating attachment of the present invention is applicable to other attachment objects besides the sheet cassette. Hereafter, an example in which attachment of an ink cartridge (a replaceable cartridge) is discriminated is described as a second application.

Referring to FIG. 4, description is given with the sheet cassette 2 as the ink cartridge 21. About each of the ink cartridges 21 (21K to 21H of FIG. 2) of a plurality of colors, a plurality of projections 600 arranged linearly on a side surface on a back surface of the ink cartridge 21 represent color identification codes of the ink.

These ink cartridges are attached to a cartridge attaching portion (see FIGS. 1 and 2) of the carriage 10. A plurality of contacts 500 are provided at the cartridge attaching portion corresponding to each of the ink cartridges 21 of a plurality of colors. When an ink cartridge 21 of any color is attached, as in the case of the example described above, an edge of the contact 500 abuts the projections 600 of the ink cartridge 21 sequentially, and an inherent coded vibration pattern is generated. Since the vibration sensor 30 is provided in the carriage 10, vibration caused by the attachment of the ink cartridge 21 to the carriage 10 may be detected sensitively. Since the carriage 10 stops when the ink cartridge 21 is replaced, the direction in which the vibration sensor 30 detects the vibration may be any of the axial directions X, Y, and Z.

The ink color may be discriminated by applying a different color identification code depending on the ink color. The middle code as illustrated in FIG. 8A is applied depending on the color of the ink. For example, a middle code A is applied to black ink, a middle code B is applied to color inks, and a middle code C is applied to a process liquid. The color ink may be subdivided for each color and a different middle code may be assigned. Besides the ink color, other characteristic data, such as date of production and place of production, of the ink cartridge 21 may be coded and identified.

Further, it is possible to assign different codes to the sheet cassette 2 and the ink cartridge 21 to discriminate these separately. In that case, by providing different front end code to the sheet cassette and to the ink cartridge, even if the sheet cassette and to the ink cartridge have the same middle code, rough classification of an article and detailed classification therein may be distinguished without confusion. Generally, the type of the article in rough classification may be distinguished by the front end code, and in detailed classification may be distinguished by the middle code. Whether the article is inserted completely is discriminated by whether the back end code is output. The procedure of analyzing the vibration pattern and determining the attachment state of the ink cartridge 21 is the same as that described in FIG. 10.

The ink cartridge 21 does not necessarily have to be mounted on the carriage 10. The cartridge attaching portion may be provided at a location distant from the carriage 10. Also in that case, information about attachment or detachment of the ink cartridge 21 may be acquired by detecting vibration.

Other Examples

The discrimination technique of the present invention is applicable also to various articles in the printing apparatus. For example, the discrimination technique is applicable to a maintenance cartridge, a print head, an openable cover, and a unit. In an electrophotographic printer, the discrimination technique is applicable to a process cartridge, a toner cartridge, and the like that are replaceable as units. The present invention may be broadly applied to situation discrimination of attachment/detachment and type discrimination of an article in other apparatuses besides a printing apparatus. It is not necessary that all of the states of the attachment/detachment and types of the article are discriminated, but at least one of these may be discriminated.

The position at which the vibration sensor 30 does not necessarily have to be provided on the carriage 10. For example, the vibration sensor 30 may be provided in a housing of the apparatus main body, a device frame, a controller board, an operation panel, and the like to acquire information about attachment or detachment of an article.

The vibration sensor 30 does not necessarily have to be an acceleration sensor as described above but may be a microphone that converts a sound wave into electrical signals. The microphone, which detects aerial vibration of sound as a sound wave, is a kind of vibration sensors broadly. In this case, information is coded in the same as described above. It is only necessary to analyze the code pattern of attachment sound generated as an article is attached.

In the examples described above, the contact is provided in the attaching portion, but the contact may be provided in the article. Specifically, it is only necessary that a code in the form of a plurality of projections or recesses arranged along the attaching direction is provided in one of the article and the attaching portion, and the contact that abuts the projections or the recesses is provided in the other of the article and the attaching portion. In either case, a coded vibration pattern is generated when the contact abuts each of a plurality of projections or recesses sequentially as the article is attached.

According to the embodiments described above, information at the time of attaching or detaching an article to or from an attaching portion may be acquired in more detail than before using a vibration sensor. No additional sensor for information acquisition is required nor no wiring of electrical cables for a sensor is required. That is, since the vibration sensor may detect that an article is attached at a location distant from the sensor without a cable (i.e., in a wireless manner), wiring of electrical cables in the apparatus may be reduced and a degree of freedom of the layout of the apparatus is increased significantly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-141408, filed Jul. 15, 2015, which is hereby incorporated by reference herein in its entirety.

What is claimed is:

1. A method for acquiring information, comprising:

detecting acceleration of a moving object by an acceleration sensor that is provided on the moving object for moving control of the moving object;

detecting a coded vibration pattern by the acceleration sensor, wherein during attachment or detachment of an article to or from an attaching portion, the coded vibration pattern is generated by contact between the attaching portion and the article; and analyzing the coded vibration pattern to acquire at least one of information representing a type of the article, information representing that the article is attached to the attaching portion, and information representing that the article is detached from the attaching portion.

2. The method according to claim 1, wherein a plurality of projections or recesses arranged in an attaching direction are provided in one of the article and the attaching portion, a contact that abuts the projections or the recesses is provided in the other of the article and the attaching portion, and the coded vibration pattern is generated when the contact abuts each of a plurality of projections or recesses sequentially as the article is attached or detached.

3. The method according to claim 2, wherein a front end code, a middle code, and a back end code are formed by the plurality of projections or recesses in a direction in which the article is inserted.

4. The method according to claim 3, wherein the middle code is a bit string arranged front/rear symmetrically.

5. The method according to claim 1, wherein the acceleration sensor is attached to a location distant from the attaching portion, and no electrical cable is provided between the attaching portion and the acceleration sensor.

6. The method according to claim 1, wherein the acceleration sensor detects the coded vibration pattern at least in a direction that is different from a moving direction of the moving object.

7. The method according to claim 1, wherein the article is a sheet cassette or a replaceable cartridge of a printing apparatus.

8. The method according to claim 2, wherein the projections or the recesses are formed by using a mold with a patterned portion used for resin molding the member to be formed.

9. A printing apparatus, comprising:

a cassette configured to store sheets and be attachable and detachable;

a carriage on which a print head is mounted, configured to reciprocate for printing, an acceleration sensor that is provided on the carriage, configured to detect acceleration of the carriage for movement control of the carriage;

a vibration generating portion configured to generate a coded vibration pattern by contact between the cassette and an attaching portion during attachment or detachment of the cassette to or from the attaching portion of the printing apparatus; and a signal analysis unit configured to analyze the coded vibration pattern detected by the acceleration sensor, wherein the signal analysis unit discriminates at least one of a type of the cassette, that the cassette is attached to the attaching portion, and that the cassette is detached from the attaching portion.

10. A printing apparatus, comprising:

a carriage on which a plurality of detachable cartridges are mounted, configured to reciprocate for printing;

an acceleration sensor that is provided on the carriage, configured to detect acceleration of the carriage for movement control of the carriage;

a vibration generating portion configured to generate a coded vibration pattern by contact between the cartridge and an attaching portion during attachment or detachment of the cartridge to or from the attaching portion of the printing apparatus; and a signal analysis unit configured to analyze the coded vibration pattern detected by the acceleration sensor, wherein the signal analysis unit analyzes the vibration pattern and discriminates at least one of a type of the cartridge, that the cartridge is attached to the attaching portion, and that the cartridge is detached from the attaching portion.

11. The printing apparatus according to claim 9, wherein the acceleration sensor is capable of detecting acceleration in a plurality of directions, and performs detection for analysis of the coded vibration pattern at least in a direction that is different from a moving direction in which the carriage reciprocates.

12. The printing apparatus according to claim 10, wherein the acceleration sensor is capable of detecting acceleration in a plurality of directions, and performs detection for analysis of the coded vibration pattern at least in a direction that is different from a moving direction in which the carriage reciprocates.

* * * * *